US010293270B1

(12) United States Patent
Fontaine

(10) Patent No.: US 10,293,270 B1
(45) Date of Patent: May 21, 2019

(54) MULTI-SKILL DEVELOPMENT AND EDUCATIONAL TOY BEAD FOR INFANTS AND A TOY PIECE OF JEWELRY COMPRISING A PLURALITY OF SUCH TOY BEADS

(71) Applicant: Fabien Fontaine, Hong Kong (CN)

(72) Inventor: Fabien Fontaine, Hong Kong (CN)

( * ) Notice: Subject to any disclaimer, the term of this patent is extended or adjusted under 35 U.S.C. 154(b) by 0 days.

(21) Appl. No.: 15/805,092

(22) Filed: Nov. 6, 2017

(51) Int. Cl.

| | |
|---|---|
| ***A63H 33/10*** | (2006.01) |
| ***A44C 13/00*** | (2006.01) |
| ***A44C 25/00*** | (2006.01) |
| ***A63H 33/06*** | (2006.01) |
| ***A63H 33/08*** | (2006.01) |
| *A44C 27/00* | (2006.01) |
| *A63F 7/40* | (2006.01) |

(52) U.S. Cl.
CPC ..... *A63H 33/062* (2013.01); *A63H 33/067* (2013.01); *A63H 33/086* (2013.01); *A63H 33/101* (2013.01); *A44C 27/001* (2013.01); *A63F 2007/4081* (2013.01)

(58) Field of Classification Search
CPC ..... A44C 13/00; A44C 27/001; F16G 15/00; F16G 15/04; A63H 33/062; A63H 33/067; A63H 33/086; A63H 33/101; A63F 2007/4081
USPC ..... 446/490, 11, 120, 121, 124, 125; 63/3, 63/3.1, 9, 38, 39, DIG. 3, 21, 23
See application file for complete search history.

(56) References Cited

U.S. PATENT DOCUMENTS

| | | | | |
|---|---|---|---|---|
| 2,540,369 A * | 2/1951 | Hume | A44C 11/002 446/124 |
| 2012/0174626 A1* | 7/2012 | Larson | A44C 11/002 63/3.1 |
| 2013/0139549 A1* | 6/2013 | Busbee | A44C 15/002 63/1.15 |

FOREIGN PATENT DOCUMENTS

| | | | |
|---|---|---|---|
| DE | 29605711 U1 * | 5/1996 | A44C 11/002 |

* cited by examiner

*Primary Examiner* — Jack W Lavinder
(74) *Attorney, Agent, or Firm* — Steven M. Greenberg, Esq.; Shutts & Bowen LLP

(57) ABSTRACT

The present invention concerns a toy bead (10, 100) comprising: two conjugated parts (11, 12; 110, 120), each part comprising a proximal end and a distal end; proximal ends of said conjugated parts comprising conjugated screwing means (11*a*, 12*a*; 110*a*, 120*a*) adapted to screw conjugated parts to each other in order to build the bead; distal ends of said conjugated parts comprising plugging means (17, 18; 170, 180), either male or female, adapted to plug said parts respectively to parts of other similar toy beads comprising corresponding plugging means; each conjugated part further comprising an internal canal (15, 16; 150, 160) extending from its proximal end to its distal end and opening to each end, the internal canal of one part being collinear to the internal canal of the its conjugated part when the conjugated parts are screwed to each other, so that a yarn can be threaded successively into internal canals of said conjugated parts.

7 Claims, 5 Drawing Sheets

Figure 1:
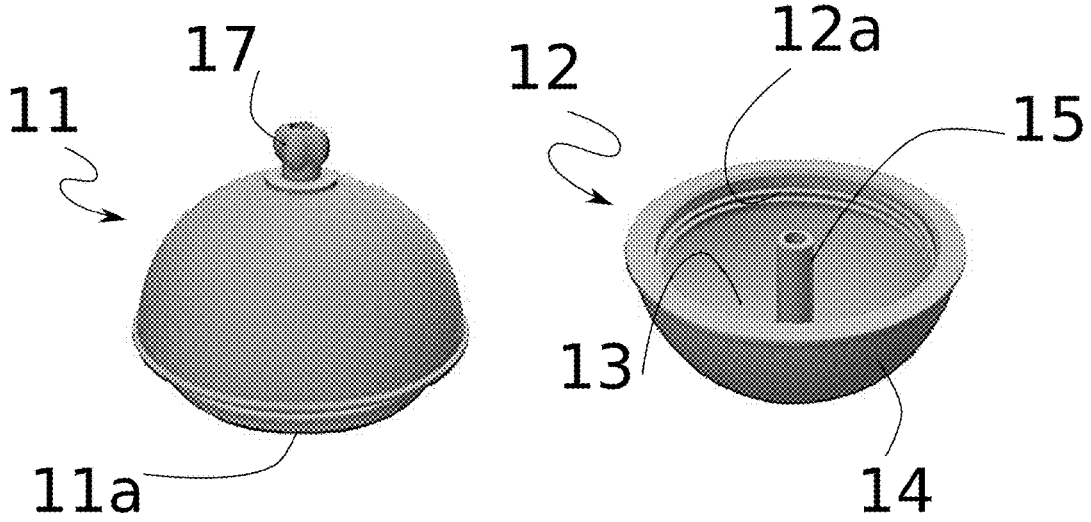

MULTI-SKILL DEVELOPMENT AND EDUCATIONAL TOY BEAD FOR INFANTS AND A TOY PIECE OF JEWELRY COMPRISING A PLURALITY OF SUCH TOY BEADS

CROSS-REFERENCE TO RELATED APPLICATIONS

This application claims priority of U.S. provisional application No. 62/516,687 filed on Jun. 8, 2017 and entitled "Toy interchangeable snap beads" which is incorporated herein by reference.

TECHNICAL FIELD OF THE INVENTION

The present invention relates to a multi-skill development and educational toy bead dedicated to simultaneously improving dexterity, ability, capacity, creativity and concentration of young children.

TECHNOLOGICAL BACKGROUND

A toy bead is a spherical or partly spherical pearl comprising an internal path adapted to receive a yarn so that a user can thread a plurality of beads on the yarn to form a bracelet, necklace, ring or similar piece of jewelry for kids.

A toy bead is well known in the art and is mainly used as a recreational activity for kids to make piece of jewelry.

EP 3037577A1 discloses a beads connecting toy comprising a base for fabricating a beaded toy which is based on a strand set member which has a strand set locking portion formed at one end side and at the other end side thereof a beading strand on which beads are put, two base strands and an engaging strand which interweaves the beading strand, the two base strands and the beads together for engagement, a one-end-side locking portion which is provided at one end side of the connecting toy main body and where the strand set locking portion is locked in place, and an other-end-side locking portion which is provided at the other end side of the connecting toy main body and where the two base strands and the beading strand are locked in place.

Such beads connecting toy enable children to make a bracelet with a certain degree of difficulty which is appropriate to teenagers. It is not suitable for young children and infants for which such beads connecting toy is too difficult to handle. In addition, once a piece of jewelry is built, the only way to create another piece of jewelry is to undo totally the first piece of jewelry and to restart a second creation.

U.S. Pat. No. 6,220,010B1 discloses an ornamental chain made up of successive elements, in which at least one of said elements includes a hollow body inside which an insert is fixed that is designed to retain a link member that is linked to an adjacent element of the chain, said insert being constituted by at least one sleeve. The sleeve includes a slot that is wide enough to enable the shank of the link member to pass there through.

Such ornamental chain enables a child to plug together successive beads by use of link members arranged between beads. It is therefore possible to easily build up some bracelet or similar piece of kid jewelry and to undo such piece of jewelry without major difficulty. However, one drawback of this toy is that it uses small pieces of link members that can be lost which will make the toy useless. In addition, the creativity is limited to the succession of beads used and can become boring after a couple of plays.

The invention aims at overcoming at least some of the drawbacks of known toy beads.

AIMS OF THE INVENTION

In particular, the invention aims to provide, in at least one embodiment of the invention, a toy bead which enables an infant to simultaneously improve his dexterity, ability, capacity, creativity and concentration.

In particular, the invention aims to provide, in at least one embodiment of the invention, a toy bead which is progressive for an infant so that he can use the toy in different manner depending of his age and his degree of maturity.

The invention also aims to provide, in at least one embodiment of the invention, a toy bead which combines several educational functionalities, in particular, lacing, twisting and plugging.

The invention also aims to provide, in at least one embodiment of the invention, a toy bead which enable to form a plurality of pieces of jewelry by combining together different toy beads.

The invention also aims to provide, in at least one embodiment of the invention, a toy bead which enables to create several pieces of jewelry with a limited number of elements so that young kids can use such beads without the risk to lose elements that would make the toy useless.

The invention also aims to provide, in at least one embodiment of the invention, a toy bead which enables to modify easily a first piece of jewelry created to create a second piece of jewelry without the need to undo totally the first piece of jewelry built.

DISCLOSURE OF THE INVENTION

The invention relates to a toy bead comprising:

- two conjugated parts, each part comprising a proximal end and a distal end,
- proximal ends of said conjugated parts comprising conjugated screwing means adapted to screw conjugated parts to each other in order to build the bead,
- distal ends of said conjugated parts comprising plugging means, either male or female, adapted to plug said parts respectively to parts of other similar toy beads comprising corresponding plugging means,
- each conjugated part further comprising an internal canal extending from its proximal end to its distal end and opening to each end, the internal canal of one part being collinear to the internal canal of the its conjugated part when the conjugated parts are screwed to each other, so that a yarn can be threaded successively into internal canals of said conjugated parts.

A toy bead according to the invention enables a child, in particular a young child to simultaneously develop his capacity to lace, twist and plug. In addition, a toy bead according to the invention enables a kid to develop his creativity by offering the possibility to combine one part of a bead with another part of another bead to form a new and unique bead. In addition, beads can be linked to each other by the plugging means without the need of additional coupling elements. In addition, the invention enables a child to create a first piece of jewelry and to easily adapt or modify this creation without the need to undo totally the first piece of jewelry. A child can remove one bead from the piece of jewelry built by unplugging this bead from the two adjacent beads, and then change the appearance of the removed bead, for example by unscrewing the two conjugated parts, to replace one or the two parts, to screw the new parts together, and to plug this new bead to the remaining chain of beads to build a modified piece of jewelry.

Advantageously, the orientation and position of screwing means and plugging means on the toy bead ensure two movements that are perpendicular to each other, a first movement of misting to screw/unscrew the parts together which is preformed in a twisting/untwisting plan (the plan of the proximal ends of the parts), and a linear movement to plug/unplug the bead from an adjacent bead, which is performed in a plan perpendicular to the twisting/untwisting plan. These movements participate in the development of the ability of an infant.

A toy according to the invention is progressive for an infant. In particular, at a very young age, the infant can only use the plugging functionality of the toy bead. When he grows up, he can further use the screwing and interchangeability functionality of the toy bead and/or the lacing functionality.

A toy bead according to the invention can present a first state, said built state, in which the two conjugated parts are screwed to each other, and a second state, said split state, in which the two conjugated parts are separated from each other. In the built state, the toy bead can be plugged into similar adjacent toy beads and further thread the beads together. In the split state, each part of the bead can be assembled to another part of another bead to form a new bead.

The form, dimension, aesthetical aspect of each conjugated part can be of different types. However, in a first embodiment, each conjugated part is hemispherical, the distal end being located on the top of the hemisphere and the proximal end being located at the base of the hemisphere.

Hemispheric parts enable forming rounded beads, similar to pearls used for adults' pieces of jewelry. This said, in other embodiments, parts can be cubic or of any shape, for example a shape of a cartoon character or an animal.

Advantageously and according to the invention, plugging means of each part extend in the direction of the internal canal of this part.

Such embodiment facilitates the insertion of a yarn once the beads are plugged to each other. In this embodiment, plugging means are hollowed and extend in the direction of the canal so that a yarn can be passed through the canal and through the plugging means.

Once the bead is built, namely once two conjugated parts are screwed together, the plugging means extend in the direction of the internal canals of said parts and this direction is perpendicular to the plan of the screwing means.

Advantageously and according to the invention said plugging means of said conjugated parts are respectively male and female.

Advantageously and according to the invention, the toy bead further comprises a centrally hollowed intermediate part with two ends, each end comprising screwing means adapted to be screwed reciprocally to the screwing means of each conjugated part, so that the intermediate part can join the conjugated parts together and extend in between the two parts when the bead is built.

Such embodiment provides another functionality which is to create a 3-parts bead. The intermediate part is adapted to be screwed to each conjugated part. In other words, a bead according to this embodiment can either be formed by the two conjugated parts screwed to each other, or be formed by the two conjugated parts and the intermediate part. Another advantage of this embodiment is that the intermediate part can present an external shape enabling to customize the bead. In one embodiment, the intermediate part is flat so that the general spherical shape of the bead is preserved. Therefore, the bead according to this embodiment presents a general spherical shape with an intermediate radial disk extending in between the two conjugated parts.

The intermediate part is centrally hollowed, which means that it comprises a central hole. This hole enables the passage of a yarn when the bead is built.

The invention also concerns a toy piece of jewelry comprising a plurality of toy beads, each toy bead comprising two conjugated parts, each part comprising a proximal end and a distal end, proximal ends of said conjugated parts comprising conjugated screwing means adapted to screw conjugated parts to each other in order to build said bead, distal ends of said conjugated parts comprising plugging means, either male or female, adapted to plug said parts respectively to parts of another toy bead of the toy jewelry, each conjugated part further comprising an internal canal extending from its proximal end to its distal end and opening to each end, the internal canal of one part being collinear to the internal canal of the its conjugated part when the conjugated parts are screwed to each other, so that a yarn can be threaded successively into internal canals of said conjugated parts.

Advantageously and according to the invention, screwing means of each bead are identical so that each part of any bead can be combined to one part of any other bead of the toy piece of jewelry.

Advantageously and according to the invention said plugging means of each bead are identical so that each part of any bead can be plugged into one part of any other bead of the toy piece of jewelry.

The invention can be opened using a screwing system to combine beads together. It provides several educational functionalities such as lacing, twisting and plugging.

The invention provides a plugging capacity as each bead has a male and/or female end that allows the beads to be connected together. The invention provides a lacing functionality as each bead has a path going through its body allowing the user to insert a thread through the bead. The invention also provides twisting functionality as each bead contains two parts that can be open using a screwing system. The diameter of each bead is the same in order that half beads can be connected together and allows multiple combinations.

LIST OF FIGURES

Figure 2:
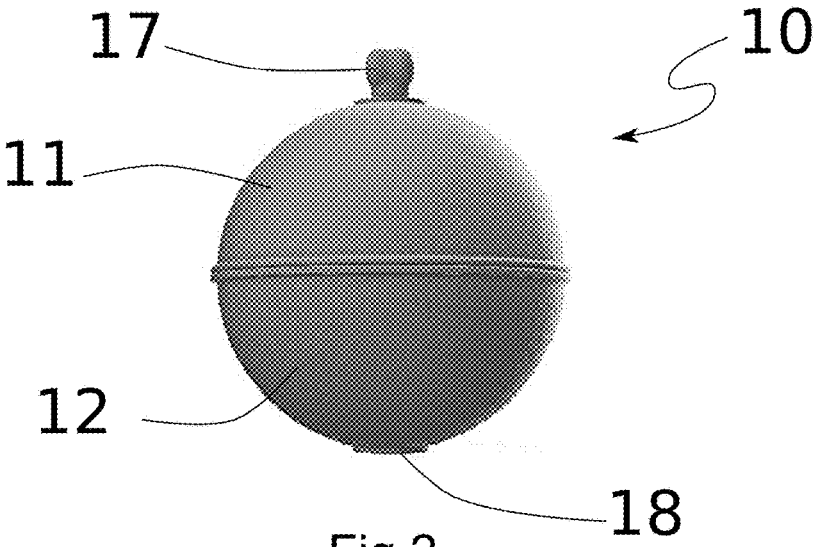
Figure 3:
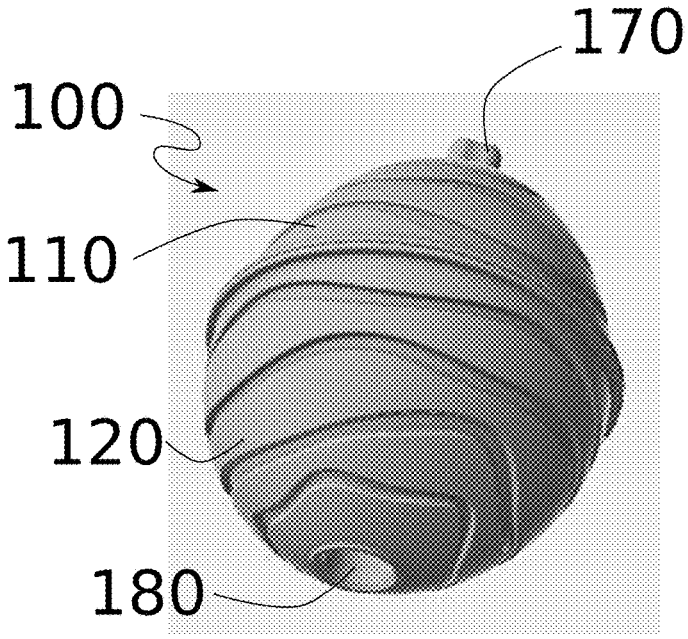
Figure 4:
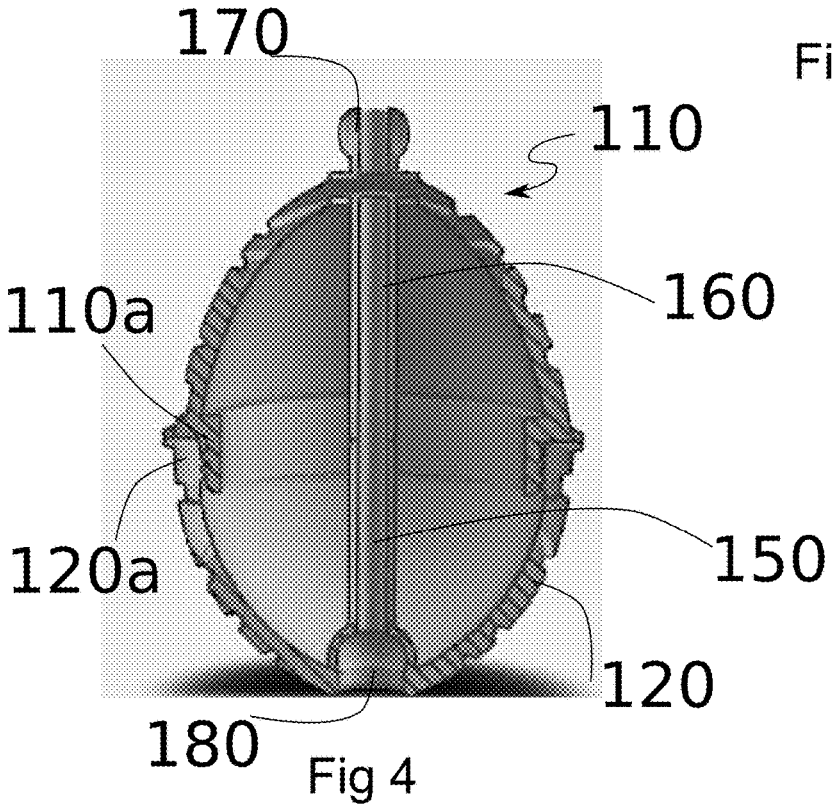
Figure 5:
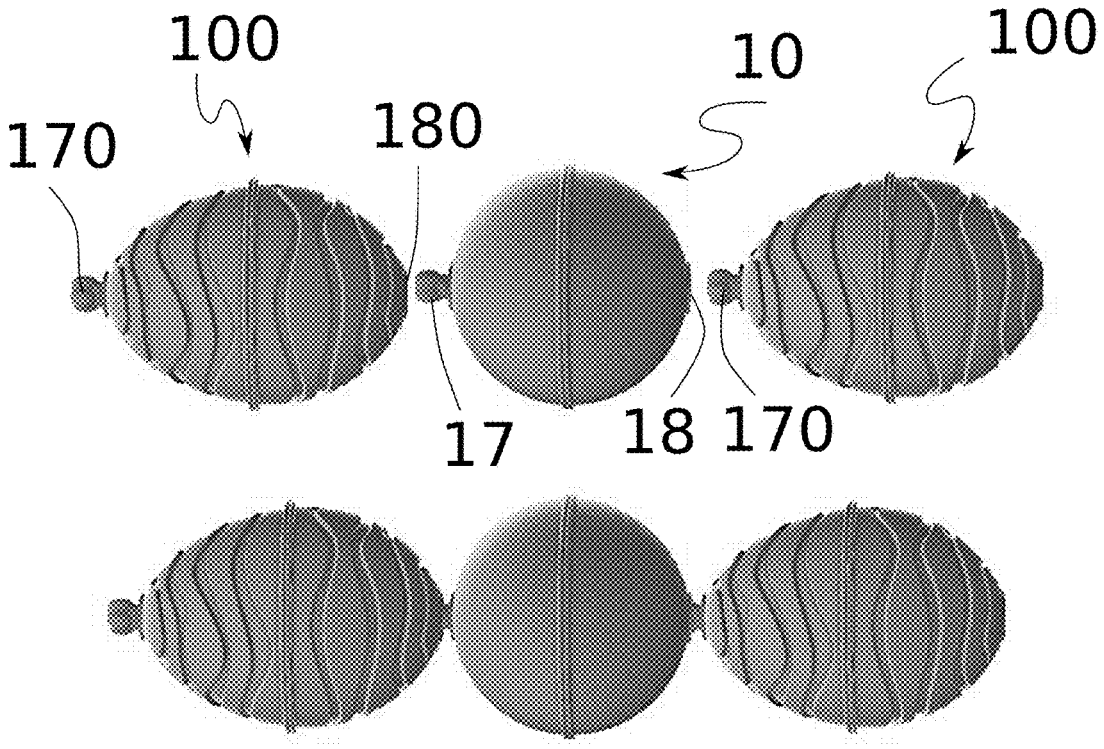
Figure 6:
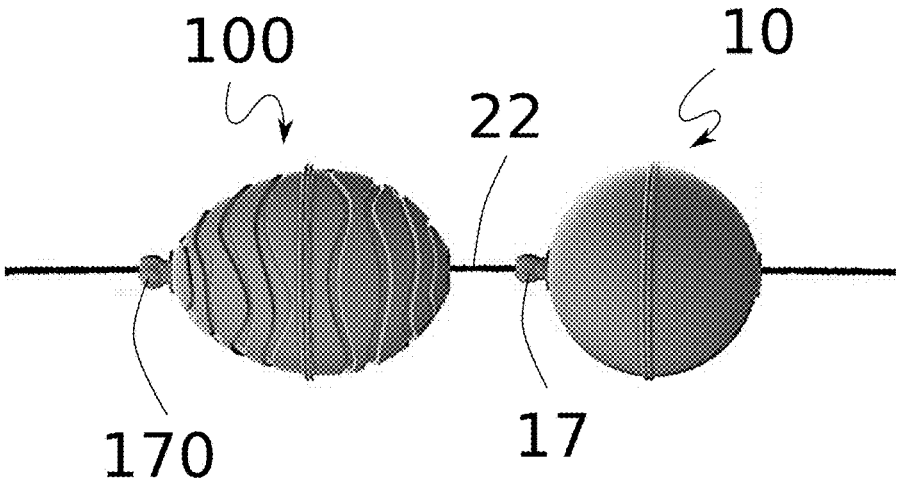
Figure 7:
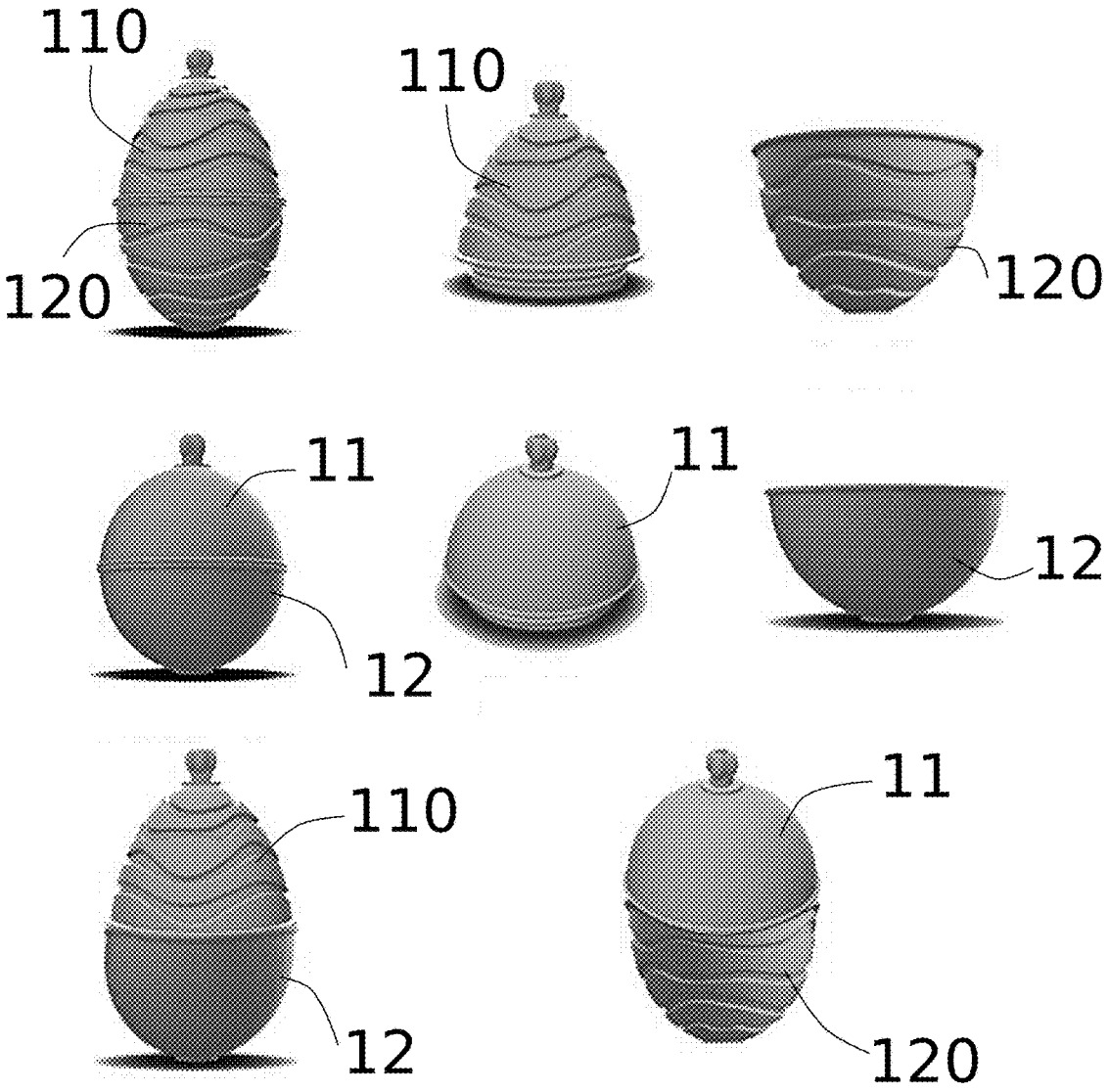
Figure 8:
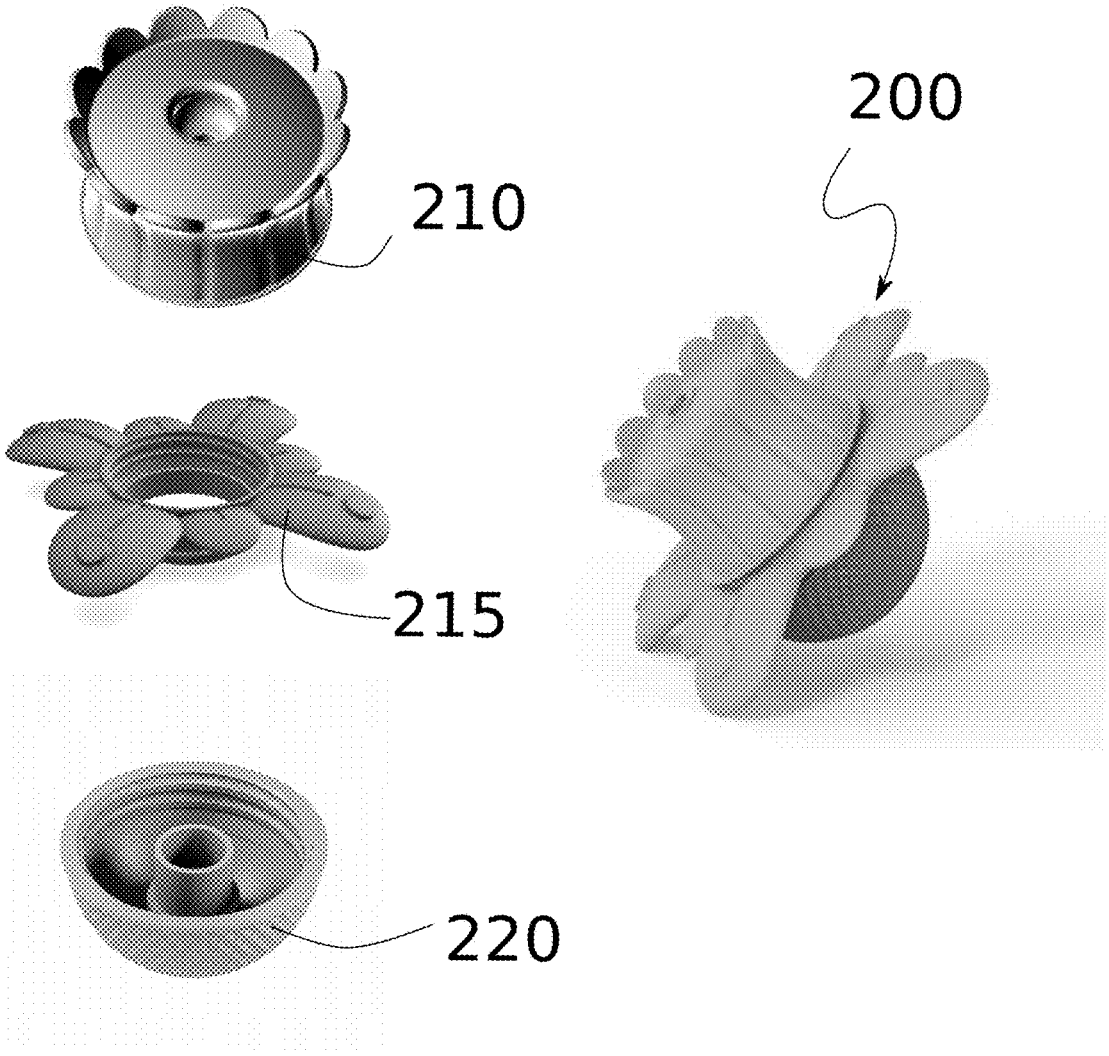

Other aims, features and advantages of the invention will emerge from reading the following description given by way of non-limiting example and with reference to the accompanying figures, in which:

FIG. 1 is a schematic representation of a toy bead according to a first embodiment of the invention in the split state, FIG. 2 is a schematic representation of the toy bead of FIG. 1 in the built state, FIG. 3 is a schematic representation of a toy bead according to a second embodiment of the invention in the built state, FIG. 4 is a schematic representation of the internal structure of the toy bead of FIG. 3, FIG. 5 is a schematic representation of the toy bead according to the first embodiment and the toy bead according to the second embodiment showing the plugging functionality of such toy beads, FIG. 6 is a schematic representation of the toy bead according to the first embodiment and the toy bead according to the second embodiment showing the lacing functionality of such toy beads, FIG. 7 is a schematic representation of the toy bead according to the first embodiment and the toy bead according to the second embodiment showing the interchangeability of such toy beads, FIG. 8 is a schematic representation of the toy bead according to another embodiment of the invention showing an intermediate part.

DETAILED DESCRIPTION OF AN EMBODIMENT OF THE INVENTION

In the figures, scales and proportions are not strictly respected, for the purposes of illustration and clarity. Identical, similar or analogous elements are designated by the same reference signs in the different embodiments. Although the description refers to one or more embodiments, this does not necessarily mean that each reference relates to the same embodiment or that features apply only to one embodiment. Single features of various embodiments may also be combined in order to provide other embodiments.

FIGS. 1 and 2 represents a toy bead 10 according to a first embodiment of the invention in the built state. The toy bead 10 comprises two conjugated parts 11, 12, said hereafter the upper part 11 and the lower part 12 of the toy bead 10. Each part presents a hollowed hemispherical shape. Such hollowed hemispherical shape defines an internal wall and an external wall. In particular, the lower part 12 comprises an internal wall 13 and an external wall 14. The external well 14 can present some specific design.

The upper part 11 comprises a proximal end comprising screwing means 11*a* adapted to be screwed in conjugated screwing means 12*a* of the lower part 12.

As shown on the FIGS. 1 and 2, the screwing means 12*a* of the lower part 12 are formed in the internal wall 13 and the screwing, means 11*a* of the upper part 11 are formed in an extension of the external wall of the upper part.

The screwing means 11*a*, 12*a* of the two conjugated parts 11, 12 of the toy bead 10 can be combined together to link the two parts together.

The man of the art will understand that the screwing means can be arranged differently without changing the results achieved by the invention. In particular, the screwing means of the lower part can be formed in the extension of the external wall while the screwing means of the lower part can be formed in the internal wall of the upper part.

FIG. 1 shows the toy bead built when the lower part 12 and the upper part 11 are screwed to each other by an action of twisting the parts respectively.

FIG. 1 also shows the internal canal 15 of the lower part 12. The upper part 11 of the toy bead comprises a similar internal canal so that, when the parts 11, 12 are screwed to each other, the internal canal of the toy bead, formed by the internal canal of the upper part and the internal canal of the lower part, extends from the distal end of the lower part to the distal end of the upper part. A yarn 22 can be introduced into the canal in order to form a piece of jewelry by combining several toy beads according to the invention as shown on FIG. 6.

As shown on FIG. 1, the toy bead further comprises plugging means 17, 18, also said snapping means. In the embodiment shown on the Figures, plugging means 17 are male while plugging means 18 are female.

Such plugging means 17, 18 enables an infant to connect beads together by slightly pressing both ends together. Therefore, the male plugging means 17 enters into the female plugging means 18 in order to connect two toy beads together, as shown on FIG. 5.

The yarn 22 can be introduced into the canal, either after beads are plugged to each other or before plugging beads to each other.

Beads according to the invention can also be used to create a piece of jewelry without the use of any yarn as the beads can be linked to each other by the plugging means.

In other words, toy beads according to the invention are versatile and provide a wide range of usage for infants.

FIG. 3 represents a toy bead 100 according to a second embodiment of the invention in the built state. The toy bead 100 comprises two conjugated parts 110, 120, said hereafter the upper part 110 and the lower part 120 of the toy bead 100. Each part presents a hollowed hemispherical shape.

Screwing means of toy bead 100 are not visible on the FIG. 3 as the toy bead is in the built state. However, the plugging means 170, 180, respectively male plugging means 170 and female plugging means 180 are shown.

FIG. 4 shows the internal structure of the toy bead 100. In particular, it shows the internal canal 150 of the lower part 120 and the internal canal 160 of the upper part 110. It also shows the screwing means 110*a* of the upper part 110 screwed in the screwing means 120*a* of the lower part 120. As it is apparent on this Figure, when the upper part and the lower part are screwed to each other, the internal canal is formed and can receive a yarn to create a piece of jewelry by combining together several toy beads according to the invention, either according to the first embodiment or to the second embodiment or to any other embodiment that will differ from the first or second embodiments essentially by the outside aspect of the parts.

FIG. 7 shows the toy bead 10 according to the first embodiment and the toy bead 100 according to the second embodiment, respectively in the split state and in the built state. It also shows the interchangeability functionality of toy beads according to the invention. In particular, the upper part 110 can be screwed either to the lower part 120 or to the lower part 12 to form a mix toy bead. The lower part 120 can be screwed either to the upper part 11 or to the upper part 110.

FIG. 8 shows a toy bead 200 according to another embodiment of the invention. It comprises two conjugated parts 210, 220, said hereafter the upper part 210 and the lower part 220 of the toy bead 200.

The toy bead further comprises an intermediate part 215 with two ends, each end comprising screwing means adapted to be screwed reciprocally to the screwing means of each conjugated part.

As shown on the right of the figure, once the bead 200 is built, the intermediate part 215 extends in between the upper part 210 and the lower part 220. The intermediate part 215 presents a general flat shape on FIG. 8. However, the man of the art will understand that the intermediate part can be of any shape without modifying the object of the invention.

The toy bead of the invention is not only limited to the embodiments describes. In particular, it is obvious that other shapes, dimensions, outside aspects of the toy bead can be used without changing the scope and results achieved by the invention.

The invention claimed is:

1. A toy bead comprising:

two conjugated parts, each part comprising a proximal end and a distal end, proximal ends of said conjugated parts comprising conjugated screwing means adapted to screw conjugated parts to each other in order to build the bead, distal ends of said conjugated parts comprising plugging means, respectively male and female, adapted to plug said parts respectively to parts of other similar toy beads comprising corresponding plugging means, each conjugated part further comprising an internal canal extending from its proximal end to its distal end and opening to each end, the internal canal of one part being collinear to the internal canal of the its conjugated part when the conjugated parts are screwed to each other, so that a yarn can be threaded successively into internal canals of said conjugated parts.

2. The toy bead of claim 1 wherein each conjugated part is hemispherical, the distal end being located on the top of the hemisphere and the proximal end being located at the base of the hemisphere.

3. The toy bead of claim 1 wherein said plugging means extend in the direction of the internal canal.

4. The toy bead of claim 1 wherein it further comprises a centrally hollowed intermediate part with two ends, each end comprising screwing means adapted to be screwed reciprocally to the screwing means of each conjugated part, so that the intermediate part can join the conjugated parts together and extend in between the two parts when the bead is built.

5. A toy piece of jewelry comprising a plurality of toy beads, each toy bead comprising two conjugated parts, each part comprising a proximal end and a distal end, proximal ends of said conjugated parts comprising conjugated screwing means adapted to screw conjugated parts to each other in order to build said bead, distal ends of said conjugated parts comprising plugging means, respectively male and female, adapted to plug said parts respectively to parts of another toy bead of the toy jewelry, each conjugated part further comprising an internal canal extending from its proximal end to its distal end and opening to each end, the internal canal of one part being collinear to the internal canal of the its conjugated part when the conjugated parts are screwed to each other, so that a yarn can be threaded successively into internal canals of said conjugated parts.

6. The toy piece of jewelry of claim 5, wherein said screwing means of each bead are identical so that each part of any bead can be combined to one part of any other bead of the toy jewelry.

7. The toy piece of jewelry of claim 5, wherein said plugging means of each bead are identical so that each part of any bead can be plugged into one part of any other bead of the toy jewelry.

* * * * *